US006039277A

United States Patent [19]

Hamm et al.

[11] Patent Number: 6,039,277

[45] Date of Patent: Mar. 21, 2000

[54] PULVERIZER

[76] Inventors: Robert L. Hamm, 10535 Sheridan Lake Rd.; Gary L. Hamm, 10520 Sheridan Lake Rd., both of Rapid City, S. Dak. 57702

[21] Appl. No.: 09/186,890

[22] Filed: Nov. 6, 1998

[51] Int. Cl.[7] ..... B02C 11/08

[52] U.S. Cl. ..... 241/189.1; 241/1; 241/193; 241/285.3; 241/301

[58] Field of Search ..... 241/1, 301, 189.1, 241/193, 188.1, 285.3

[56] References Cited

U.S. PATENT DOCUMENTS

| | | |
|---|---|---|
| 1,297,497 | 3/1919 | Rosenthal . |
| 1,630,992 | 5/1927 | Waterman . |
| 1,728,976 | 9/1929 | Nobis . |
| 2,108,609 | 2/1938 | O'Mara . |
| 2,922,586 | 1/1960 | Hardinge . |
| 3,003,707 | 10/1961 | Lecher . |
| 3,284,010 | 11/1966 | Bodine, Jr. . |
| 3,342,426 | 9/1967 | Sackett, Sr. . |
| 3,473,741 | 10/1969 | Bodine . |
| 3,567,141 | 3/1971 | Zbraniborski . |
| 3,794,251 | 2/1974 | Williams . |
| 4,947,906 | 8/1990 | Schroeder . |
| 5,184,781 | 2/1993 | Andela . |
| 5,248,101 | 9/1993 | Rose et al. . |
| 5,322,104 | 6/1994 | Morey et al. . |
| 5,577,669 | 11/1996 | Vujnovic ..... 241/301 |
| 5,697,563 | 12/1997 | Fujimoto et al. . |

FOREIGN PATENT DOCUMENTS

| | | | |
|---|---|---|---|
| 1724355 | 4/1992 | U.S.S.R. | 241/193 |

*Primary Examiner*—Mark Rosenbaum
*Attorney, Agent, or Firm*—Merchant & Gould P.C.

[57] ABSTRACT

A pulverizer which reduces solid materials having moisture content to a powder-like material in a single pass through the pulverizer. The pulverizer of this invention utilizes a plurality of radially extending flexible chains associated with anvils oriented outwardly and above the ends of the chains for disintegrating solid materials into fine aggregate material similar to dust or powder. The chains and anvils produce a kinetic energy and standing sound waves to fracture materials and vaporize moisture in the materials with the characteristics of the kinetic energy and standing sound waves being varied depending upon the structural characteristics of the rotatable chains and anvils, the spatial relationship between the chains and anvils, the angular position of the anvils and the rotational speed of the chains. Materials having overall sizes between 1½ to 2 inches may be pulverized and reduced to a size to pass through a 200 mesh screen in a single pass and is capable of removing moisture from the material which has up to 60% of moisture by weight to produce a completely dry powder or dust-like material.

12 Claims, 5 Drawing Sheets

PULVERIZER

BACKGROUND OF THE INVENTION

1. Field of the Invention

The present invention generally relates to a pulverizer and more specifically to a pulverizer which reduces solid materials having moisture content to a powder-like material in a single pass through the pulverizer utilizing a plurality of radially extending flexible chains moving with respect to fixed anvils oriented outwardly of the ends of the chains and above the chains. The present invention is particularly adapted to pulverize solid materials having overall sizes between about 1½ to about 2 inches to a size to pass through a 200 mesh screen in a single pass. The pulverizer is capable of removing moisture from solid materials having up to about 60% moisture by weight to produce a completely dry powder or dust-like material.

2. Description of the Prior Art

Various patents have been granted relating to developments in pulverizers, material crushers, material separators and the like in which various products are pulverized, crushed, fractured and separated.

The following U.S. patents disclose devices for pulverizing, crushing and fracturing and otherwise separating materials as to size and reducing moisture content:

| | | |
|---|---|---|
| 1,297,497 | 3,284,010 | 4,947,906 |
| 1,630,992 | 3,342,426 | 5,184,781 |
| 1,728,976 | 3,473,741 | 5,248,101 |
| 2,108,609 | 3,567,141 | 5,322,104 |
| 2,922,586 | 3,794,251 | 5,697,563 |
| 3,003,707 | | |

While the above patents disclose various pulverizers, crushers, separators and the like, the previously patented devices are substantially different from the present invention in their method of operation and structural details.

U.S. Pat. No. 1,297,497 discloses an apparatus having chain flails and rib-plates in succession to fracture the husks from nuts and air flow to separate the components. This patent primarily uses the actual impact forces of the nut to do the fracturing and does not reduce all of the material contained into a fine-ground material. U.S. Pat. No. 1,630,992 discloses an apparatus for conveying and separating materials from a ball type mill. Ball mills use tumbling balls to impact and crush material repeatedly until it is small enough to pass out of the machine. U.S. Pat. No. 1,728,976 discloses a coal pulverizing apparatus using chain flails to impact and throw the material against the outer walls of the chamber thus fracturing the coal. The apparatus uses a succession of chains to progressively reduce the material as it passes through the cylinders. The apparatus in U.S. Pat. No. 2,108,609 rejects the heavier material from the airstream and redirects it back to the pulverizer. This process is repeated until the material is fine enough to pass out of the machine. U.S. Pat. No. 2,922,586 discloses an apparatus primarily for handling and treating the discharge of manufactured material after a mill has processed it. The apparatus in U.S. Pat. No. 3,003,707 uses rotating blades that vibrate. The material is passed through a liquid filled cylinder that uses the fluid to grind the material.

The apparatus in U.S. Pat. Nos. 3,284,010 and 3,473,741 generate a sonic wave-like action. The solids material is passed through a narrowing passage between two anvils that incorporate a sonic wave-like action to crush the material.

U.S. Pat. No. 3,342,426 discloses a pulverizing mill which uses chain flails and a chain curtain to pulverize the material without too much fine powder. The material is impacted by the chain flails and thrown against the chain curtain thus pulverizing it in the process. U.S. Pat. No. 3,567,141 discloses an apparatus employing centrifugal force to throw the solid material against the outer chamber walls. This process is repeated and the material recycled until the material is fine enough to pass through the screen and out of the machine. U.S. Pat. No. 3,794,251 discloses an apparatus using an air-circulating system to control the material size, separate the fines and circulate heated air to dry the material. The debarker of U.S. Pat. No. 4,947,906 uses flailing chains to sever and remove the outer bark from logs by impacting them with the chains. In U.S. Pat. No. 5,184,781, chain flails are used to repeatedly impact solid glass material until it is reduced to small enough pieces to pass out of the machine. The crusher disclosed in U.S. Pat. No. 5,248,101 uses centrifugal force to throw the material against a set of outer anvils. This process is repeated until the material is fine enough to exit the machine. U.S. Pat. No. 5,322,104 discloses a machine which also uses chain flails to impact the logs thereby severing the limbs and removing the outer bark. The crusher in U.S. Pat. No. 5,697,563 also uses chain flails, which impact and throw the material against an outer vessel with anvils inclined in such a way so as to redirect the material back toward the chains. The process is repeated until the material is fine enough to exit the machine.

While the above described machines and apparatuses include various rotatable members and other movable structures for pulverizing, crushing or fracturing solid materials, none of the above patents combine the use of a chain flail and rubber backed anvil plates and none of the patents suggest a combination creating standing sound waves and kinetic energy for crushing and fracturing the material particles as utilized in the present invention. While pulverizers and crushers are known to direct particles towards stationary anvil members, they do not provide angled anvils associated with a rotating chain flail which reflects sound waves and kinetic energy to fracture the materials that are introduced into the chamber in which the anvils and rotating flails are disposed.

SUMMARY OF THE INVENTION

The pulverizer of this invention receives solid materials from a feed conveyor or other structure and deposit the materials downwardly into a flail having a plurality of flexible chains connected to a center hub or plate associated with anvils in a manner to pulverize and fracture the various materials. The pulverized material is discharged into a cyclone separator for discharging comminuted solid material through a rotary valve structure and recirculating air from the center of the cyclone separator back into an air flow path to entrain comminuted material from the pulverizer for movement through the separator. The pulverizer includes a plurality of flexible chains which swing in a generally horizontal plane from a central hub. The horizontally rotating chain flail is associated with anvil plates positioned preferably both radially outwardly from the ends of the chains and above the chains.

The anvil plates both outwardly from the ends and above the rotating chains are oriented at angles relative to the path of movement of the chains. The rotating chains create turbulence and produce sound waves that are reflected by the anvil plates to create the conditions that fracture materials that are introduced into the pulverizer. The anvils have preferably a rubber or semi-rigid cushioning material between the anvil and a reflecting plate which allows the reflecting plate to move or flex slightly in response to impact by the solid materials in order to assist in setting up the kinetic energy and standing sound waves within the pulverizing chamber. The fractured materials are then sucked from the pulverizer chamber and separated by the cyclone separator. The air flow component from the separator can either be vented to the atmosphere or recirculated to the pulverizing chamber depending on the solids material being fractured and the desired characteristics for the final products.

Thus, it has been found that the apparatus of the present invention can effectively disintegrate solid materials into fine aggregate material similar to dust or powder. The chains and anvils produce a kinetic energy and standing sound waves to fracture the solid materials and vaporize moisture in the materials with the characteristics of the kinetic energy and standing sound waves being varied depending upon the structural characteristics of the rotatable chains and anvils, the spatial relationship between the chains and anvils, the angular position of the anvils and the rotational speed of the chains.

Accordingly, the pulverizer of this invention is especially adapted to process high moisture content materials and dry such materials as the apparatus vaporizes the moisture into water vapor. By regulating the rotational speed of the chains, air velocity, air volume, deflecting angles of the anvils and recycling or venting air depending on the moisture content, the characteristics of the fractured solid particles and the moisture content of the finished product can be controlled. The cyclone can then separate the fractured solid materials from the air flow.

The pulverizer of this invention can also be utilized in processing any product that requires finely ground materials and moisture. It can be effectively utilized when recycling glass, compost and the like, when pulverizing various grains, and when pulverizing ores, limestone and other mined materials, as well as in the manufacture of pharmaceuticals and the like.

It is therefore an object of the present invention to provide a pulverizer for fracturing materials at dissimilar surfaces by the use of kinetic energy and standing sound waves.

Another object of the invention is to provide a pulverizer utilizing rotatable flexible chains that fracture solid materials that are introduced into the pulverizer with the chains creating turbulence and propagating standing sound waves that are reflected by anvil plates to create the conditions for fracturing the materials introduced into the pulverizer.

A further object of the invention is to provide a pulverizer in accordance with the preceding objects combined with a cyclone separator which sucks the fractured materials, air and water vapor from the pulverizer chamber, with the cyclone separator separating fractured solid materials from the air flow which can be either vented to atmosphere or recirculated depending upon the material being fractured and the characteristics desired for the products produced by the combined pulverizer and cyclone separator.

Still another object of the present invention is to provide a pulverizer in accordance with the preceding objects which can reduce a wide range of materials having external maximum dimensions of about 1½ to about 2 inch in size to particles that will pass through a 200 mesh screen and finer, in one pass of the materials through the pulverizer.

A still further object of the invention is to provide a pulverizer utilizing kinetic energy and standing sound waves to fracture materials and to vaporize moisture in a final product with the characteristics of the final product being determined by adjusting the operational characteristics of the pulverizer in accordance with the materials being pulverized.

These together with other objects and advantages which will become subsequently apparent reside in the details of construction and operation as more fully hereinafter described and claimed, reference being had to the accompanying drawings forming apart hereof, wherein like numerals refer to like parts throughout.

DESCRIPTION OF THE PREFERRED EMBODIMENT

Figure 1:
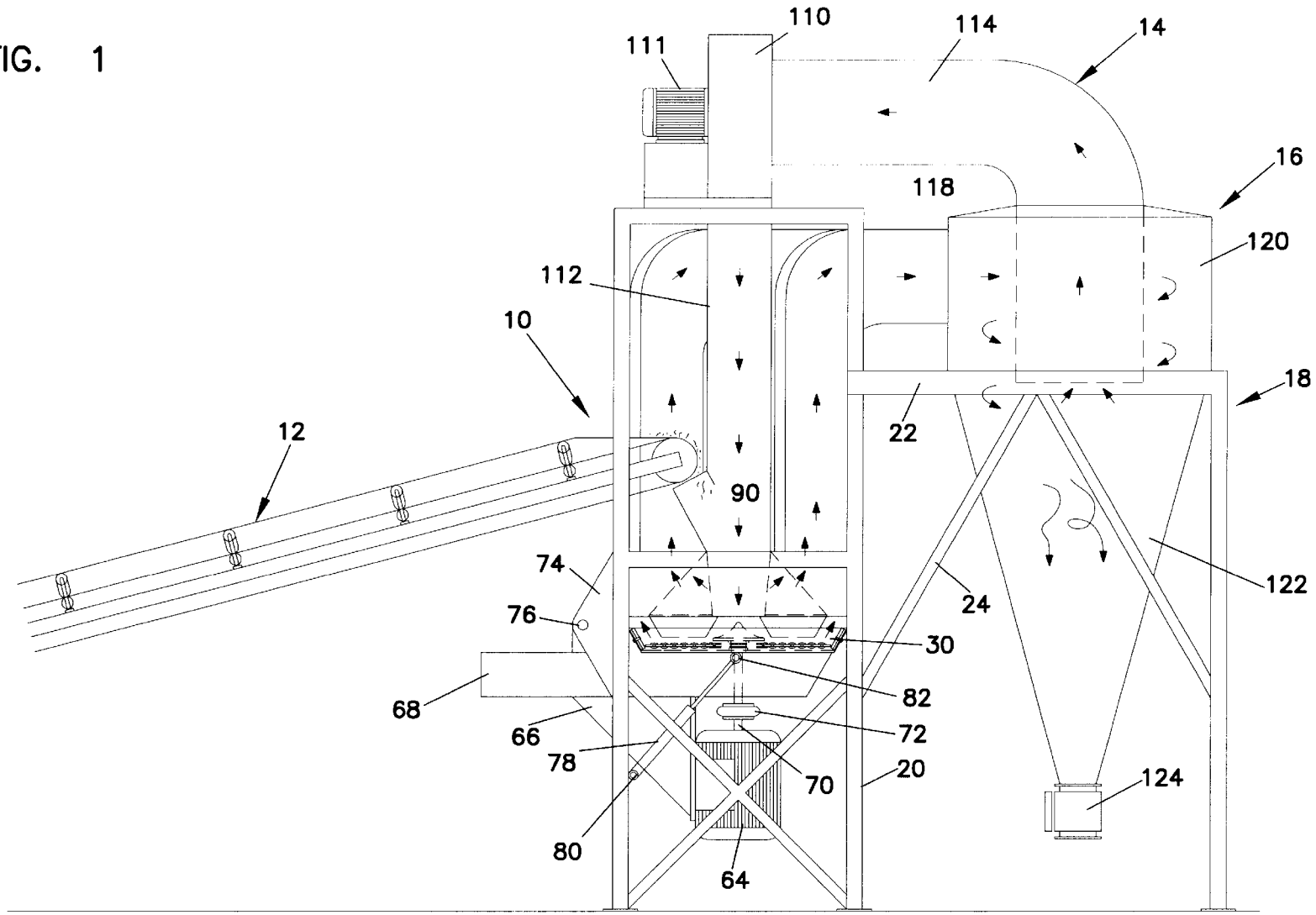
FIG. 1 is a side elevational view of a preferred pulverizer constructed in accordance with the present invention and associated with a feed conveyor and cyclone separator.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 2:
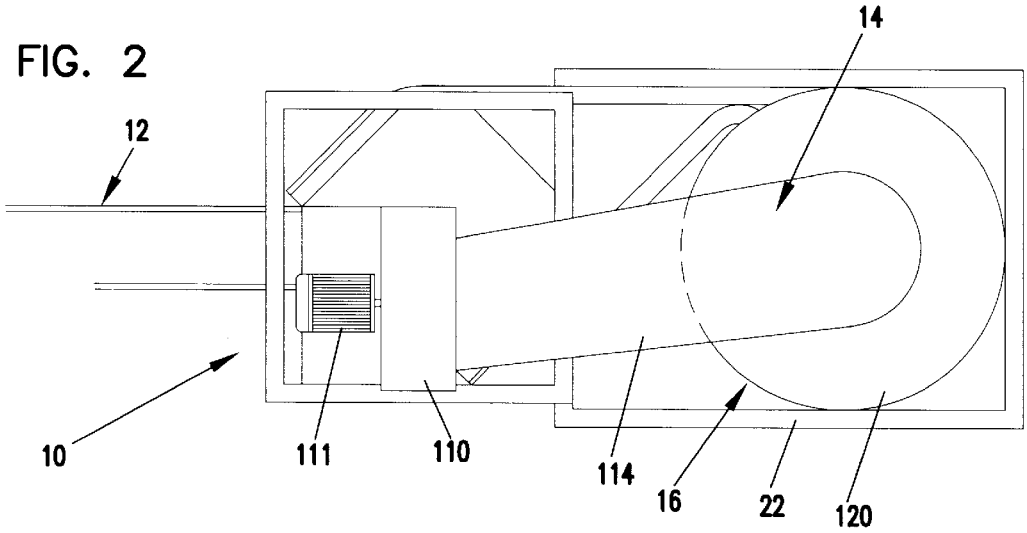
FIG. 2 is a top plan view of the construction of the structure illustrated in FIG. 1.
Figure 3:
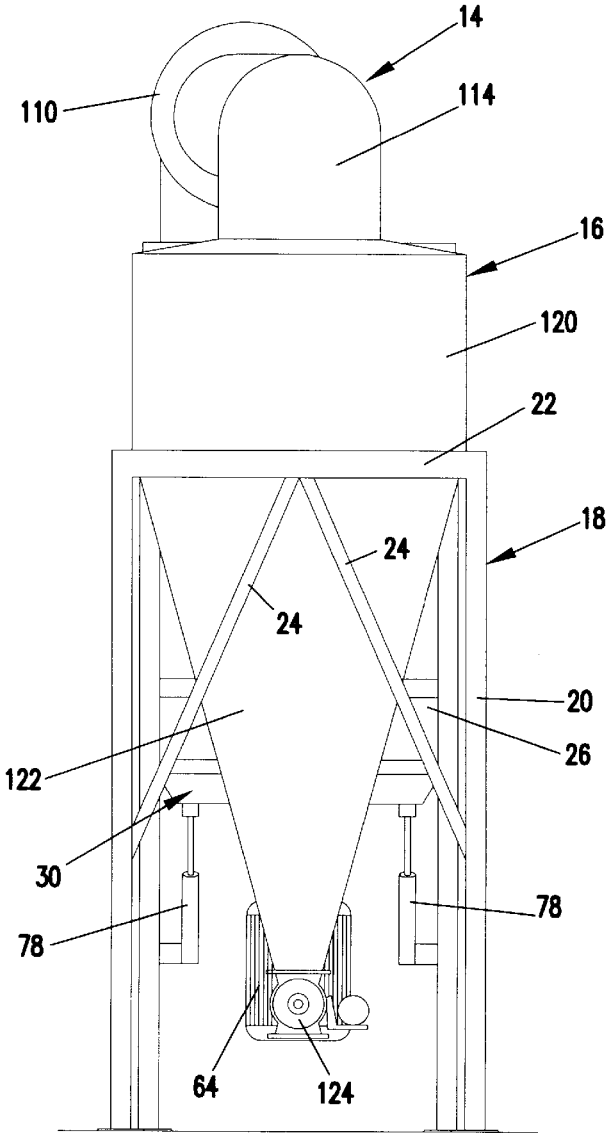
FIG. 3 is an end elevational view illustrating the association of the cyclone with the pulverizer.

Referring to the drawings, FIGS. 1–3 illustrate the orientation of the preferred components of the present invention including a pulverizer generally designated by the numeral 10 which receives material to be fractured from a feed conveyor 12 and is associated with an air circulation system generally designated by the numeral 14. The air circulation system 14 includes a separator such as a cyclone separator generally designated by the numeral 16. The pulverizer 10 and air circulation system 14 with cyclone separator 16 are all preferably supported from a supporting frame generally designated by 18. The supporting frame 18 includes vertical frame members 20, horizontal frame members 22 and angled braces 24 oriented and connected to each other in a manner to form a rigid supporting framework for the components of the pulverizer.

The pulverizer 10 includes a housing 26 defining a pulverizing chamber generally designated by the numeral 28, which receives material to be fractured from the feed conveyor 12. The housing 26 is preferably round in cross-section.

Figure 4:
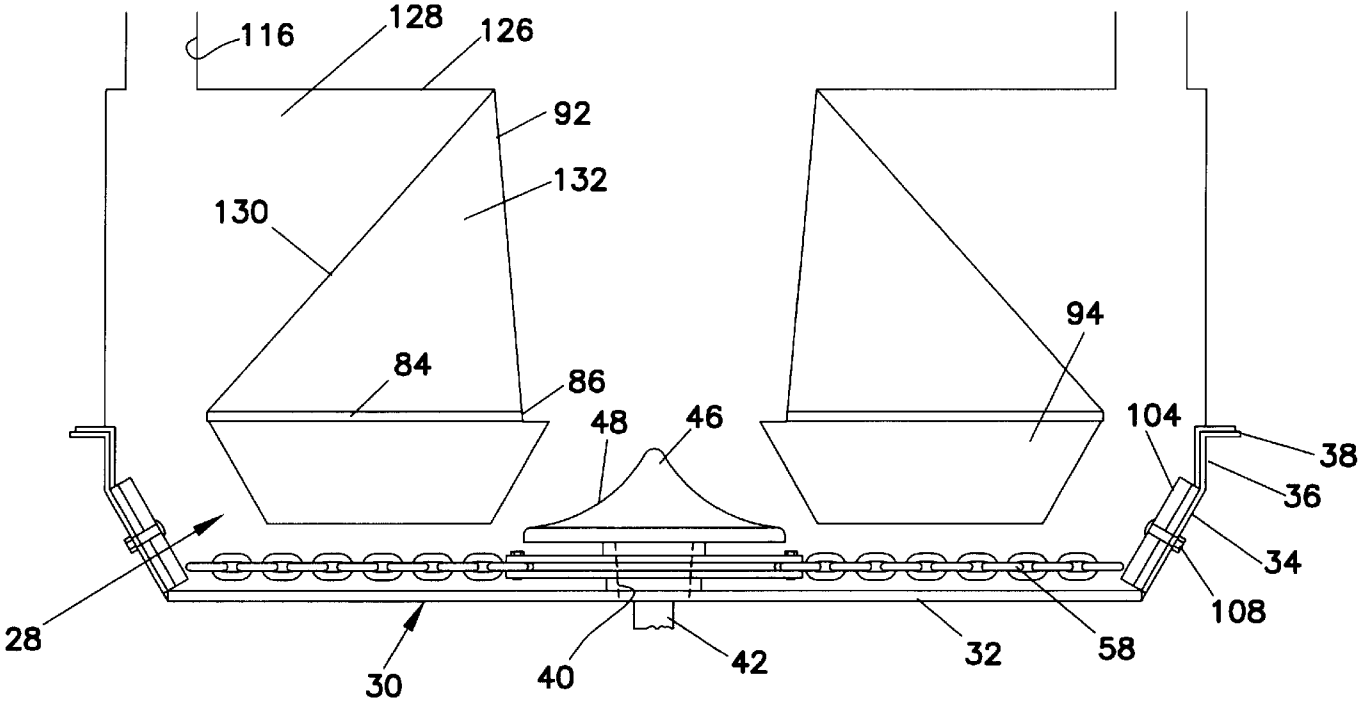
FIG. 4 is a sectional view of the pulverizer including the pulverizing chamber for receiving solids material to be fractured, the rotatable chain flail assembly and associated anvils.
Figure 5:
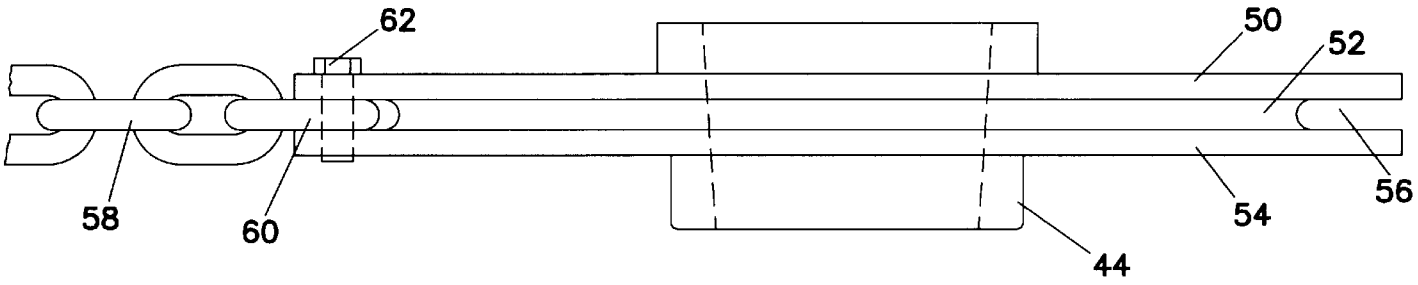
FIG. 5 is an enlarged fragmental sectional view illustrating the chain flail hub and the attachment of the chains to the hub.
Figure 6:
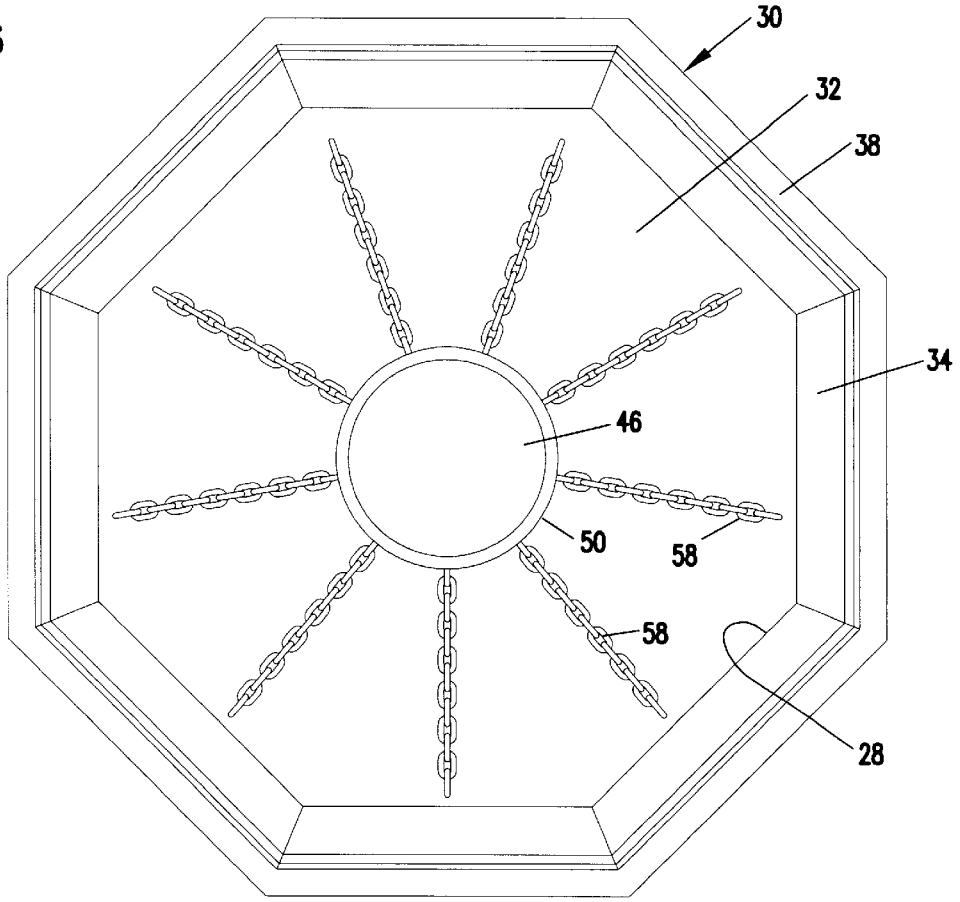
FIG. 6 is a plan view of the flail and angled side anvils oriented outwardly of the flail.
Figure 8:
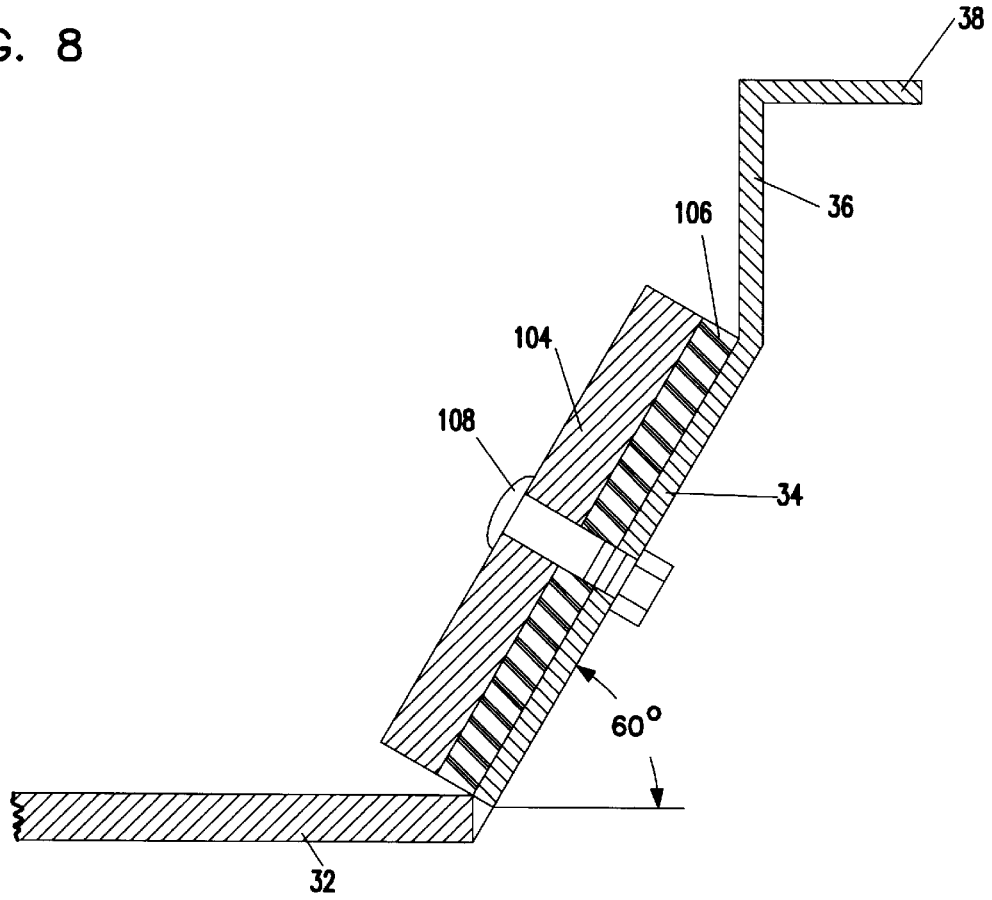
FIG. 8 is an enlarged fragmental sectional view of the anvils oriented radially outwardly from the chain flail.

The bottom of the pulverizing chamber 28 is defined by a pan shaped bottom member generally designated by 30 including an octagonal plate 32 having an upwardly and outwardly inclined peripheral wall segments 34 each of which form an anvil. Each of the wall segments 34 terminate in a vertical peripheral wall 36 and an outwardly extending generally horizontal flange 38, as illustrated in FIG. 8. Extending vertically through an aperture 40 generally in the center of the plate 32 is a drive shaft 42 having a tapered hub 44 mounted thereon and oriented above the plate 32 as illustrated in FIG. 4. The hub 44 includes a generally circular, conical deflector 46 at its upper end having preferably concave peripheral wall portions 48. Also rigidly affixed to the hub 44 is a series of generally circular plates 50, 52 and 54. The top and bottom plates 50 and 54 are slightly larger than the center plate 52 to define a peripheral groove 56 which receives an end link 60 of a chain 58. The end link 60 is inserted between the peripheral edges of the plates 50 and 54 into the slot or groove 56 and a retaining bolt 62 passes through the plates 50 and 54 and through the end link 60 to detachably connect the chains 58 to the hub 44. As illustrated in FIG. 6, nine chains 58 are connected to the hub to form a chain flail with the outer ends of the chains terminating adjacent the upwardly angled peripheral wall segments 34 on the pan shaped bottom member 30. While nine chains 58 have been illustrated, more or less chain lengths can be used in accordance with the present invention.

The drive shaft 42 is driven by an electric motor 64 supported on frame 18 as by a gusset 66 affixed to a beam 68 which extends under and supports the bottom member 30 as illustrated in FIG. 1. The drive shaft 42 is connected to the output shaft 70 of the motor 64 by a coupling 72. The beam 68, support 66, motor 64 and bottom pan member 30 are all pivoted by support brackets 74 rigid with frame members 20 for pivotal movement about a pivot axis 76 defined by a shaft or bolt arrangement. A pair of hydraulically powered rams 78 extend between the frame members 20 at a point below the bottom member 30, as indicated at reference numeral 80, to a pivotal connection 82 to the beam 68. The hydraulic rams 78 and pivot 76 enable the beam 68, support 66, motor 64, drive shaft 42, hub 46, chains 58 and bottom pan member 30 to be swung downwardly about pivot axis 76 so that the chamber 28 can be opened to provide access to the interior of the chamber and its bottom to replace components and remove any material that may become lodged in the chamber.

Figure 9:
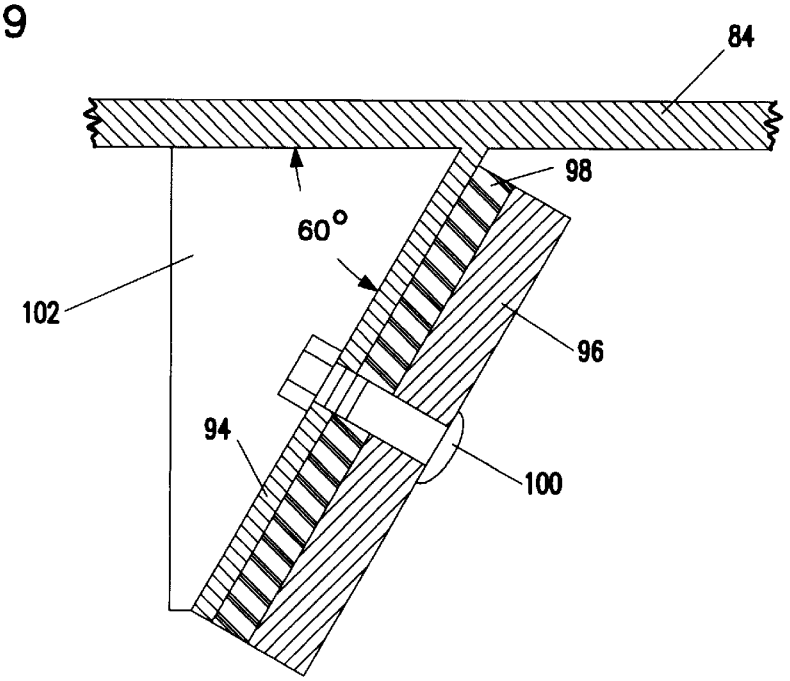
FIG. 9 is an enlarged fragmental sectional view of the anvils oriented above the chain flail.

Positioned above the chains 58 is a plate 84 having a large central opening 86 and a peripheral edge 88. The peripheral edge 88 includes straight line segments 89 oriented in angular relation to define an octagonal shape for outer edge 88 which corresponds with an octagonal shape of the bottom pan plate 32. The inner edge of opening 86 also has eight straight line portions which define an octagonal shape for opening 86 above the hub 44 and deflector 46. The opening 86 provides an inlet for the solids material to be fractured which is deposited into the chamber 28 by the feed conveyor 12 and a chute 90. Chute 90 discharges the material into a vertical throat or inlet 92 above the plate 84 and connecting with the edge of the opening 86. Supported from the bottom surface of the plate 84 are eight anvils 94 which depend from the plate 84 and are oriented in angular relation to the plate 84 with the included angle between the plate 84 and the anvils 94 being preferably about 60°, as illustrated in FIG. 9.

Figure 7:
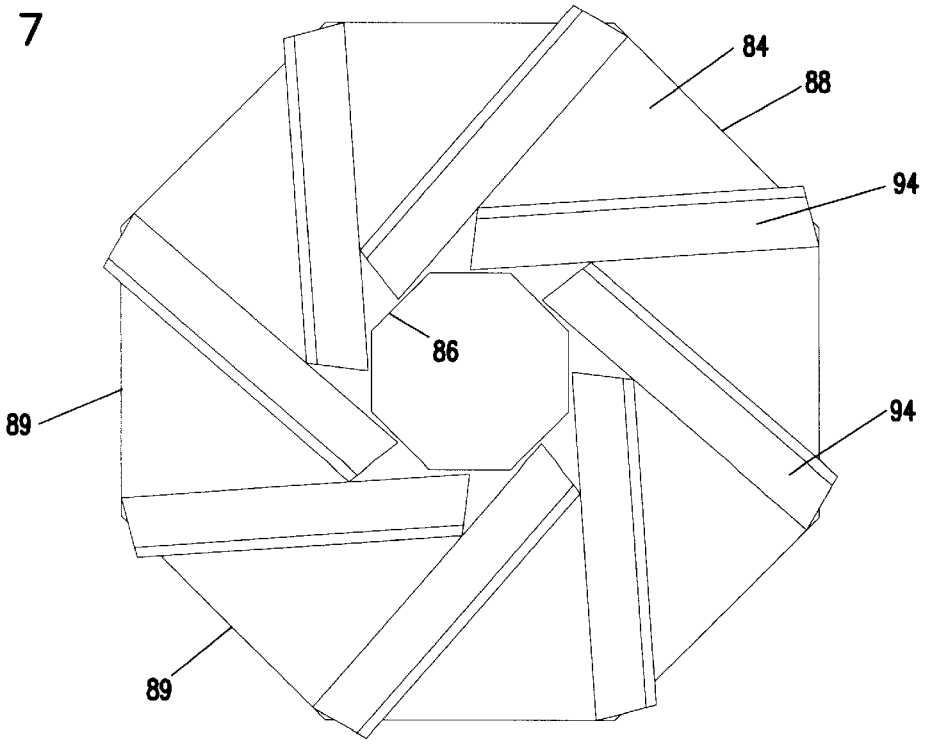
FIG. 7 is a bottom view of the anvils which overlie the chain flail.

The anvils 94 are generally tangential to the straight side portions of the opening 86 and extend outwardly to a juncture between straight line segments of the outer edge 88 of plate 84 as illustrated in FIG. 7. Also, the ends of the anvils 94 diverge upwardly from a bottom edge toward a top edge (as shown in FIG. 4) with the top edge being approximately 25 inches in length and the bottom edge approximately 23 inches in length. Each anvil 94 includes a rigid reflecting metal plate 96 and a panel of cushioning material 98 between the rigid anvil 94 and the rigid reflecting plate 96 with a pair of carriage bolts 100 securing the reflecting plate 96 and the cushioning material 98 to the anvil 94. The cushioning material is preferably rubber but can be any semi-rigid material that provides the necessary cushioning, such as neoprene or the like. The reflecting plate is preferably a hot rolled metal of rigid construction that may be ¾ inch in thickness and 6 inches in width. The rubber cushioning material may be ½ inch in thickness and 6 inches in width with the ends shaped in accordance with the anvil 94. Also, each anvil 94 is reinforced by a triangular gusset 102 welded to the plate 84 and the anvil 94 across the acute angle of 60° included between the plate 84 and the anvil 94 as illustrated in FIG. 9.

Each of the inclined wall segments 34 on the pan shaped bottom plate 32 is also preferably oriented in about a 60° relation to the horizontal plane of the bottom plate 32 as illustrated in FIG. 8. Each of the inclined wall segments or anvils 34 also includes a wear plate 104 mounted on the inner surface thereof and spaced from the wall segment 34 by a cushioning material, such as rubber cushion 106. The wear plate 104 and rubber cushion are secured to the inclined wall segment 34 by a pair of carriage bolts 108 or other adequate fasteners. The inclination of the wear plate 104 is generally similar to and parallel to the outer edge of the anvils 94 with the wear plates 104 and the inclined wall segments 34 defining an octagonal structure with the inclined wear plates 104 and wall segments 34 being the same in number as the straight line edges of the plate 84. The number of wall segments 34 and wear plates 104 as well as the number of anvils 94 and reflecting plates 96 and the plates 32 and 84 will be shaped to correspond to the changes in the number of anvils 94 and 34.

The air circulation system 14 includes a blower 110 driven by motor 111 and having an outlet 112 extending downwardly toward the chamber 28, past the chute 90 and communicating with the inlet 92 for the material to be fractured. The blower 110 also includes an inlet 114 communicated with the cyclone separator 16. Air and entrained fines or dust particles move outwardly from the inlet 92 up through a peripheral passageway 116 from the chamber 28 and into an inlet 118 connected tangentially to the cylindrical chamber 120 at the larger upper end of the cyclone separator 16. Air and entrained fines are separated by the centrifugal movement of the air and fines in the cylindrical chamber 120 with the heavier particles moving outwardly and downwardly along an inverted cone shaped lower end 122 of the separator for discharge through an outlet 124, preferably in the form of a rotary valve structure.

Meanwhile, the air passes upwardly through the inlet duct 114 extending to the inlet of the blower 110 so that the air can be recirculated by the blower down through the outlet 112 onto the deflector 46 and then outwardly and upwardly through passageways 116 and into the inlet for the cyclone separator 16. Downward movement of the air from the discharge 112, through the inlet 92 entrains the material discharged from the feed conveyor down into the opening 92 to entrain the fines therein with the air then moving up through the passageways 116. Alternatively, the blower 110 could exhaust part or all of the air or recirculate part or all of the air in order to control the moisture content of the fines produced by this invention. Also, the velocity and temperature of the recirculated air may be varied to determine the moisture content of the fines removed from the cyclone separator.

The area of the chamber 28 outwardly of the plate 84 and below a wall 126 defines a plenum chamber 128 with an inclined wall 130 combining with the cylindrical wall 92 and the plate 84 to form a void area 132.

The standing wave reflection plates 96 or anvils 94 which are rubber cushioned may vary in angular relation from about 20° to about 60° depending on the material being fractured and the reduction wanted. The drive motor 64 has a variable output and has a horsepower range between 100 and 150. The blower motor 111 may be variable speed and can be adjusted to the moisture content and reduction required along with the selection of recycling the air or venting the air. The cyclone separator separates the small particulate material or fines from the air flow and the structural details may be varied to the velocity required and the material to be sized.

The capability of the present invention to pulverize material and remove moisture as part of a single process reduces the time and expense as compared to separate fracturing and moisture reduction. The rotational speed of the chains forming the chain flail may vary to produce standing sound waves which causes expansion of moisture and vapor and expansion of material which breaks the material apart at dissimilar surfaces. Standing sound waves are created as each individual molecule passes energy onto and into its adjacent molecules. After the sound wave has passed, each molecule remains in about the same location. The sound-waves/shock-waves created by the chains spinning in the transonic range from 0.85 to 1.3 of Mach, are reflected back toward their source by reflector plates 96 strategically placed within the chamber 28. Sound waves reflect when one medium encounters a different medium. The sound-waves, movement, shock waves and turbulence created by the chain flails cause kinetic energy to excite the molecules causing the molecules to move rapidly thus causing expansion of moisture, thus vapor and expansion of material which breaks the material apart at dissimilar surfaces.

The speed of Mach is affected by density, pressure and temperature, so a combination of velocity of air stream to sweep the material from the chamber, the speed of the flailing chains and temperature, moisture and density of re-cycled air can be adjusted for best results.

Some of the material does contact the chain flails 58, which helps to distribute the material and some of the material may impact the reflecting plates 96. However, contact is minimal and very little wear occurs on these parts. The mechanical tolerances within the pulverizer are very large, and there is nothing to stop the large material from exiting the chamber from centrifugal force. However, larger particles tend not to pass out between the wear plates 104 and the ends of reflector plates 96 when chains 58 are rotating because of the reverse incline of the anvils 94 being not parallel to chains 58 causing the turbulence to create some reverse flow above chains 58 and the zone above the chains is so violent that material being processed is disintegrated into fine powders before it can pass the end of the reflecting anvils 94. The pulverizer will take 1½ to 2 inches diameter infeed solid materials and reduce the materials to fine powder in one pass, exiting the machine just as quickly as it entered. The moisture content of the finished product can be controlled by how soon the material is separated from the air stream. Thus, drying the wet material being processed.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A pulverizer for fracturing solid materials comprising a housing having an inlet for material to be pulverized and an outlet for discharging pulverized material, a rotor mounted in said housing, a power device driving said rotor about a substantially vertical axis, said rotor including a central member having a plurality of flail members connected thereto and extending outwardly therefrom when the rotor is rotated, said housing including anvils oriented in spaced relation above said flail members, said anvils reflecting sound waves produced by said flail members for fracturing solid materials and producing finely ground material.

2. A pulverizer for fracturing solid materials comprising a housing having an inlet for material to be pulverized and an outlet for discharging pulverized material, a rotor mounted in said housing, a power source driving said rotor, said rotor including a central member having a plurality of flail members connected thereto and extending outwardly therefrom when the rotor is rotated, said housing including anvils oriented in spaced relation to said flail members, at least some of said anvils reflecting sound waves produced by said flail members for fracturing solid materials and producing finely ground material, said sound wave reflecting anvils being rigid metal anvils oriented above the flail members, and including a reflector plate reflecting sound waves produced by the rotating flail members.

3. The pulverizer as defined in claim 2, wherein said flail members are in the form of flexible chains.

4. The pulverizer as defined in claim 2, wherein each of said anvils includes a rubber cushion supporting the reflector plates on the anvils.

5. The pulverizer as defined in claim 2, wherein said central member includes a hubs said hub including a deflector having an upwardly facing surface receiving material to be pulverized, said flail members being connected to said deflector, said deflector deflecting material to be pulverized outwardly between said flail members and anvils.

6. The pulverizer as defined in claim 5, wherein said sound wave reflecting anvils are oriented in angular relation to the plane of movement of the flail members when the rotor is rotated.

7. The pulverizer as defined in claim 1, wherein said housing includes a generally pan shaped bottom member receiving said rotor and flail members, said bottom member including a plurality of inclined wall segments oriented peripherally outwardly of the flail members and forming wear plates oriented in angular relation to the plane of movement of the flail members.

8. The pulverizer as defined in claim 7 together with a frame supporting said pulverizer housing, said bottom member being hingedly connected to said frame to permit said bottom member to pivot downwardly for access to the interior of the housing for maintenance and removal of oversize material.

9. The pulverizer as defined in claim 8 together with lift members interconnecting said frame and bottom member to pivot the bottom member between an operative position with said wall segments oriented peripherally outwardly of the flail members and a downwardly extending inoperative position to provide access to the interior of the housing and rotor.

10. The pulverizer as defined in claim 1 combined with an air circulation system including a blower and a cyclone separator communicated with the blower and housing for circulating air through the housing to entrain material fractured by the reflected sound wave for separation of solid fines from air circulated through the housing and cyclone separator.

11. A pulverizer for fracturing solid materials comprising a housing having an inlet for material to be pulverized and an outlet for discharging pulverized material, a plurality of generally horizontal rotating flails driven about a substantially vertical axis, said housing including anvils oriented in spaced relation above said flails, said material inlet introducing material to be pulverized above said flails, said flails being in the form of flexible chains driven at a high speed to produce sound waves, said anvils reflecting sound waves to fracture material to be pulverized.

12. The pulverizer as defined in claim 11, wherein said housing includes a plurality of upwardly and outwardly inclined wear plates oriented outwardly of said chains for discharge of pulverized material upwardly toward a cyclone separator.

* * * * *